US006971944B2

(12) United States Patent
Berman et al.

(10) Patent No.: US 6,971,944 B2
(45) Date of Patent: Dec. 6, 2005

(54) METHOD AND CONTROL SYSTEM FOR IMPROVING CMP PROCESS BY DETECTING AND REACTING TO HARMONIC OSCILLATION

(75) Inventors: Michael J. Berman, West Linn, OR (US); Steven E. Reder, Boring, OR (US); Bruce Whitefield, Camas, WA (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 10/779,966

(22) Filed: Feb. 17, 2004

(65) Prior Publication Data

US 2005/0181706 A1 Aug. 18, 2005

(51) Int. Cl.[7] ..... B24B 1/00

(52) U.S. Cl. ..... 451/5; 451/41; 451/1; 451/287; 451/288; 451/11; 451/166

(58) Field of Search ..... 451/5, 41, 11, 166, 451/1, 287, 288; 324/76.21; 438/5; 248/550; 381/71.1, 76.1; 73/660

(56) References Cited

U.S. PATENT DOCUMENTS

| | | | | |
|---|---|---|---|---|
| 4,419,897 | A * | 12/1983 | Matsuoka | 73/660 |
| 5,222,329 | A * | 6/1993 | Yu | 451/11 |
| 5,439,551 | A * | 8/1995 | Meikle et al. | 438/5 |
| 5,789,678 | A * | 8/1998 | Pla | 73/660 |
| 5,852,667 | A * | 12/1998 | Pan et al. | 381/71.1 |
| 6,210,259 | B1 * | 4/2001 | Malkin et al. | 451/166 |
| 6,424,137 | B1 * | 7/2002 | Sampson | 324/76.21 |
| 6,443,416 | B1 * | 9/2002 | Jones | 248/550 |

* cited by examiner

*Primary Examiner*—George Nguyen
(74) *Attorney, Agent, or Firm*—Trexler, Bushnell, Giangiorgi & Blackstone, LTD

(57) ABSTRACT

A method and control system for detecting harmonic oscillation in a chemical mechanical polishing process and reacting thereto, such as by taking steps to at least one of: 1) reduce or eliminate the harmonic oscillation; and 2) counter the noise which is associated with the harmonic oscillation. By reducing or eliminating harmonic oscillation, films with reduced structure strengths including low k dielectric films can be used. By countering the noise, the quality of the work environment is improved.

22 Claims, 5 Drawing Sheets

METHOD AND CONTROL SYSTEM FOR IMPROVING CMP PROCESS BY DETECTING AND REACTING TO HARMONIC OSCILLATION

BACKGROUND

The present invention generally relates to methods and control systems associated with chemical mechanical polishing processes. More specifically, the present invention relates to a method and control system for detecting harmonic oscillation in a chemical mechanical polishing process and, in response, taking steps to either: 1) reduce or eliminate the harmonic oscillation; or 2) counter the noise which is typically associated with harmonic oscillation in a chemical mechanical polishing process.

Manufacturing an integrated circuit, for example, is a multiple step process. Among the steps which are typically performed is a chemical mechanical polishing (CMP) process which is used to polish or planarize a wafer (e.g., copper, low k dielectrics and other films). As shown in FIG. 1, in a chemical mechanical polishing process, a wafer 10 is held in a wafer carrier 12, and is pressed against a polishing pad 14 which is disposed on a polishing table 16. Both the wafer carrier 12 and polishing table 16 are then rotated (as indicated by arrows 18 in FIG. 1), and slurry is supplied on the pad 14 via a stationary slurry dispense line 20. The stationary slurry dispense line 20 is used to drip slurry 22 on the pad 14 in front of the wafer 10.

Sometimes, during a chemical mechanical polishing process, harmonic oscillation is experienced. Harmonic oscillation can be caused by the interaction of the down force on the wafer carrier, revolutions per minute (RPM) of the platen, and RPM of the polishing head and polishing table.

When harmonic oscillation manifests itself, typically there is a loud, high pitch noise (around 80–100 decibels). Tolerating the loud noise, especially for any substantial length of time, is uncomfortable for the typical employee. In many fabrications, there is a need (i.e., when a plurality of tools are running) to wear ear protection, typically either ear plugs or headsets. Wearing such ear protection is inconvenient and uncomfortable, as well as a hindrance to normal communication in the workplace, such as peer-to-peer, supervisor-to-employee and emergency communications. As such, the noise associated with harmonic oscillations in a chemical mechanical polishing process is a major drawback towards the goals of good communications, comfort and safety in the work environment.

The harmonic oscillation also sets up an oscillation, or resident vibration, in the complete polishing system. This, including the forces applied at the surfaces of the wafer, causes an oscillation or periodic increase on the forces on the films being polished. This is like a small "jack hammering" of the interconnect structure. For films which are not low k, this is not a problem (i.e., other than the occurrence of the noises and increased tool wear). However, if there is a low k film in the stack being polished, this oscillation in the forces is a major problem. One of the key problems with integration of low k films is the structural integrity of the film. The lower the k value of the film, the lower the structural integrity of the film. For this reason, harmonic oscillation, or any increase in the forces applied to the film, presents a major yield and reliability problem with regard to the structural integrity of low k films. When harmonic oscillation occurs during processing, there is a substantial increase in the localized forces on the surface of the wafer. Because this increase in forces is not consistent, it does not occur all the time or at the same points in the process. Therefore, harmonic oscillation can result in forces and stresses that are considerably greater than the process as characterized or qualified. This often causes one of the primary failure modes seen with integration of low k films: delamination, cracking and sheer-induced voiding. All of these results have an effect on die, reduced yield and potential reliability failures. The harmonic oscillation problem is especially prevalent with regard to large, rigid polishing tables.

Current, typical solutions to these problems include, for example: limiting the type of films being polished; reducing the down force being applied; and generally operating the polisher in a very sub-optimum set of conditions. Because harmonic oscillations normally occur in the polishing process, the processing parameters and film stack must have a lot of robustness. Harmonic oscillation limits the available choices in low k films, structures and processes.

OBJECTS AND SUMMARY

An object of an embodiment of the present invention is to provide a method and control system for detecting harmonic oscillations in a chemical mechanical polishing process and reacting thereto.

Still another object of an embodiment of the present invention is to perform experiments and then react, based on results of the experiments, to harmonic oscillation as it occurs in a chemical mechanical process.

Briefly, and in accordance with at least one of the foregoing objects, embodiments of the present invention provide a method and control system for detecting harmonic oscillation in a chemical mechanical polishing process and reacting thereto, such as by taking steps to at least one of: 1) reduce or eliminate the harmonic oscillation; or 2) counter the noise which is associated with the harmonic oscillation.

One embodiment of the present invention provides a method wherein harmonic oscillation associated with the chemical mechanical polishing process is detected, and then one or more characteristics of the process are changed to reduce or eliminate the harmonic oscillation. For example, slurry flow can be increased, the down force pressure can be changed, or the rotational velocity of the wafer carrier or polishing table can be changed. Regardless, by reducing or eliminating harmonic oscillation during the process, films with reduced structure strengths including low k dielectric films can be used. In other words, the chemical mechanical polishing process need no longer require that robust films be used, because the films need not have to withstand the effects of harmonic oscillations, which would otherwise be experienced.

Another embodiment of the present invention provides a control system for reducing harmonic oscillation in a chemical mechanical polishing process, where the control system is configured to detect harmonic oscillation, and is configured to change at least one characteristic of the chemical mechanical polishing process to eliminate, or at least reduce, the harmonic oscillation which has been detected.

Other embodiments of the present invention provide a method and control system wherein harmonic oscillation associated with a chemical mechanical polishing process is detected, and then either an audio signal is generated and broadcasted to counter noise or a vibration signal is generated and coupled to the platen to counter the harmonic oscillation. By countering the noise, the quality of the work environment is improved and the harmonic vibration that damages the substrate is eliminated without other process changes.

Still yet other embodiments of the present invention provide a method and control system wherein harmonic oscillation is detected, and the noise associated with the harmonic oscillation is countered while the harmonic oscillation is either reduced or eliminated by changing one or more characteristics of the chemical mechanical polishing process.

BRIEF DESCRIPTION OF THE DRAWINGS

The organization and manner of the structure and operation of the invention, together with further objects and advantages thereof, may best be understood by reference to the following description, taken in connection with the accompanying drawing, wherein.

DESCRIPTION

Figure 1:
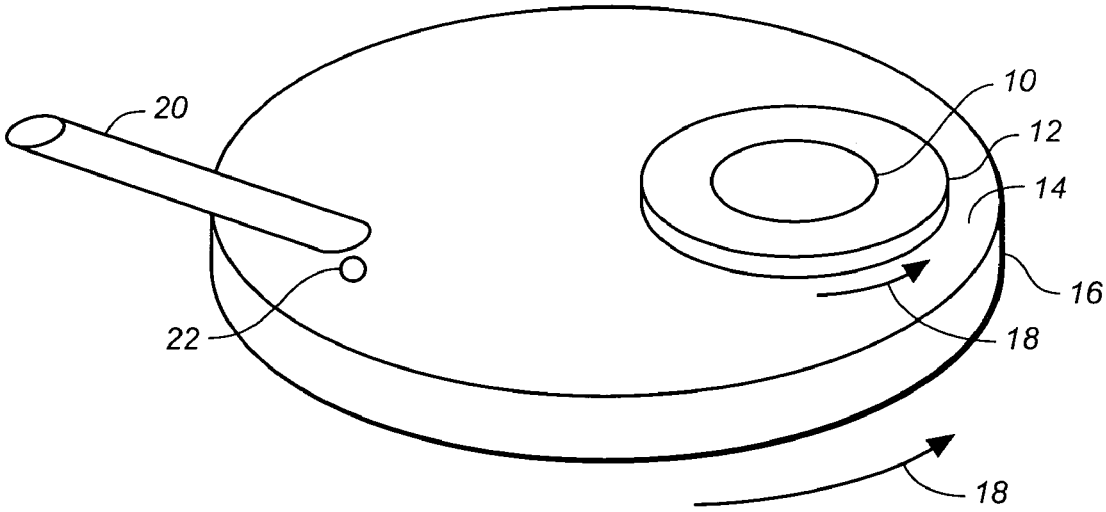
FIG. 1 illustrates a polishing table and wafer carrier in a chemical mechanical polishing process.

While the invention may be susceptible to embodiment in different forms, there are shown in the drawings, and herein will be described in detail, specific embodiments of the invention. The present disclosure is to be considered an example of the principles of the invention, and is not intended to limit the invention to that which is illustrated and described herein.

FIGS. 2, 4, 6, 8 and 10 relate to methods which are in accordance with the present invention, and FIGS. 3, 5, 7, 9 and 11 relate to control systems which are in accordance with the present invention, and which can be used to practice the methods shown in FIGS. 2, 4, 6, 8 and 10, respectively. The methods and control systems at least one of: reduce or eliminate harmonic oscillation in a chemical mechanical polishing process, and counter the noise associated with harmonic oscillation. By reducing or eliminating harmonic oscillation during a chemical mechanical polishing process, lower k dielectric films can be used. In other words, the chemical mechanical polishing process need no longer require that robust films be used, because the films need not have to withstand the effects of harmonic oscillations, which would otherwise be experienced. By countering the noise associated with harmonic oscillation, the work environment is improved. For example, ear protection need not be worn, and communication in the work environment is no longer hindered.

Figure 2:
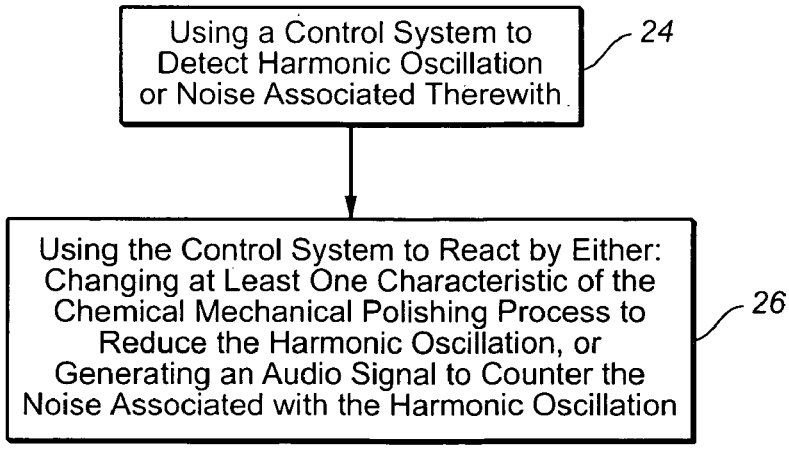
FIGS. 2, 4, 6, 8 and 10 relate to methods which are in accordance with the present invention.

As shown in FIG. 2, the method includes using a control system to detect either harmonic oscillation or noise associated therewith (box 24 in FIG. 2), and using the control system to react (box 26 in FIG. 2) by at least one of: changing at least one characteristic of the chemical mechanical polishing process to reduce the harmonic oscillation, and generating a signal to counter the harmonic oscillation.

Figure 3:
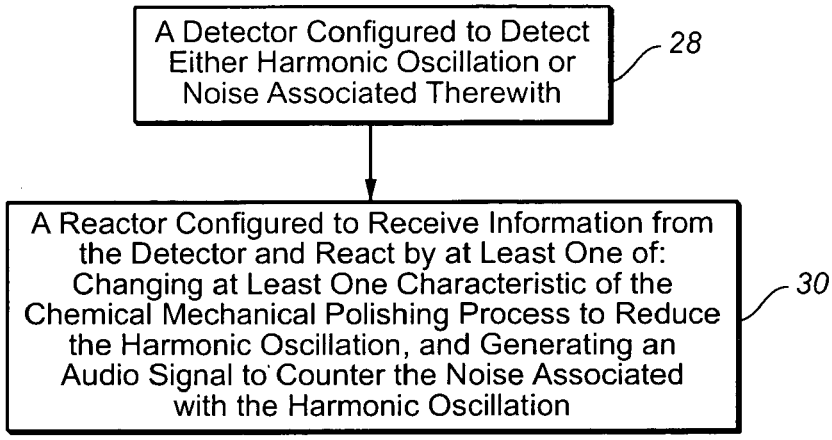
FIGS. 3, 5, 7, 9 and 11 relate to control systems which are in accordance with the present invention, and which can be used to practice the methods shown in FIGS. 2, 4, 6, 8 and 10, respectively.

FIG. 3 illustrates a control system which can be used to practice the method illustrated in FIG. 2. The control system includes a detector (box 28 in FIG. 3) configured to detect either harmonic oscillation or noise associated therewith, and a reactor (box 30 in FIG. 3) configured to receive information from the detector and react by at least one of: changing at least one characteristic of the chemical mechanical polishing process to reduce the harmonic oscillation, and generating an audio signal to counter the noise associated with the harmonic oscillation.

Figure 4:
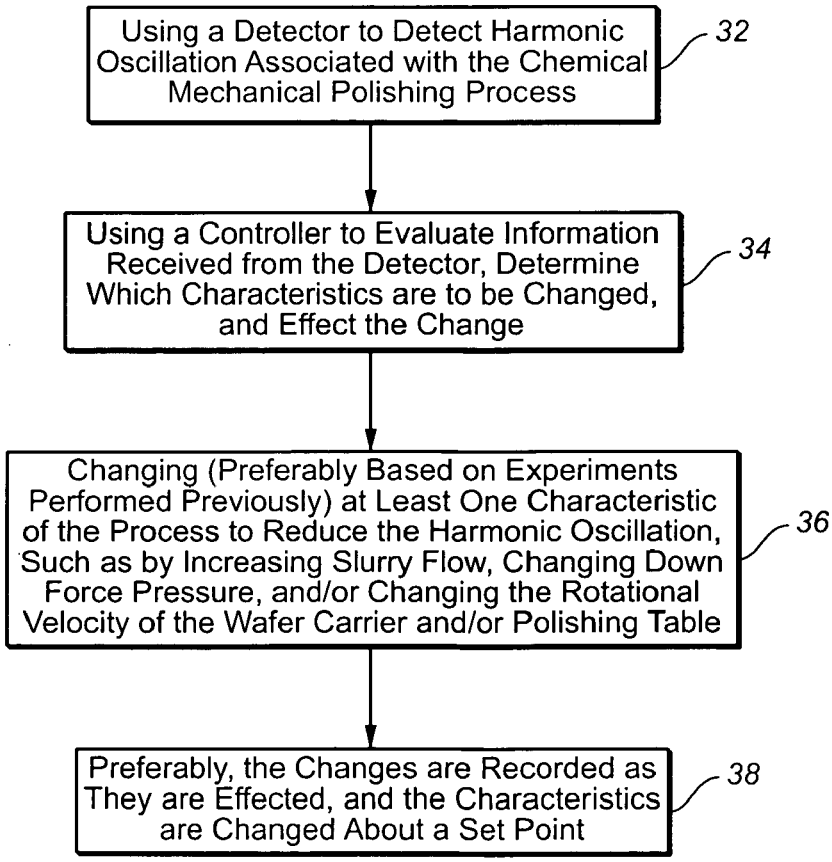

FIG. 4 illustrates a method which is directed at reducing or eliminating harmonic oscillation. The method includes using a detector (box 32 in FIG. 4) to detect harmonic oscillation associated with the chemical mechanical polishing process, and using a controller (box 34 in FIG. 4), preferably a Model Predictive Controller, to evaluate information received from the detector, determine which characteristics of the chemical mechanical polishing process are to be changed to reduce or eliminate the harmonic oscillation which has been detected, and effect the change. Specifically, when detecting harmonic oscillation, preferably a frequency is sensed and time analysis is performed to determine whether harmonic oscillation is occurring. Thereafter, changes are effected (box 36 in FIG. 4). For example, slurry flow can be increased, the down force pressure can be changed, or the rotational velocity of the wafer carrier or polishing table can be changed. Preferably, the changes are recorded, and are effected about a set point (box 38 in FIG. 4). To determine which characteristics should be changed and to what degree in order to reduce or eliminate harmonic oscillations (such as during the first, second, third, fourth occurrence, etc. during processing), preferably experiments are performed beforehand. For example, changes in down force or velocity are preferably based upon the data collected during previous experiments, and would typically be on the order of a 3 to 5% increase or decrease around a target set point. Preferably, the actual actions and interactions are tested and are be unique for each tool, due to variances in table mass and geometries.

Additionally, detection analysis can be completed to determine the harmonic spectrum associated with particles scratching of the surfaces. Many of the scratches show a characteristic chatter mark. This mark is associated with the velocity vector of the relative motion of the wafer surface against a stationary particle embedded in the polishing pad. These sets of conditions set up a unique frequency and associated harmonics that may be detectable by this type of system.

Figure 5:
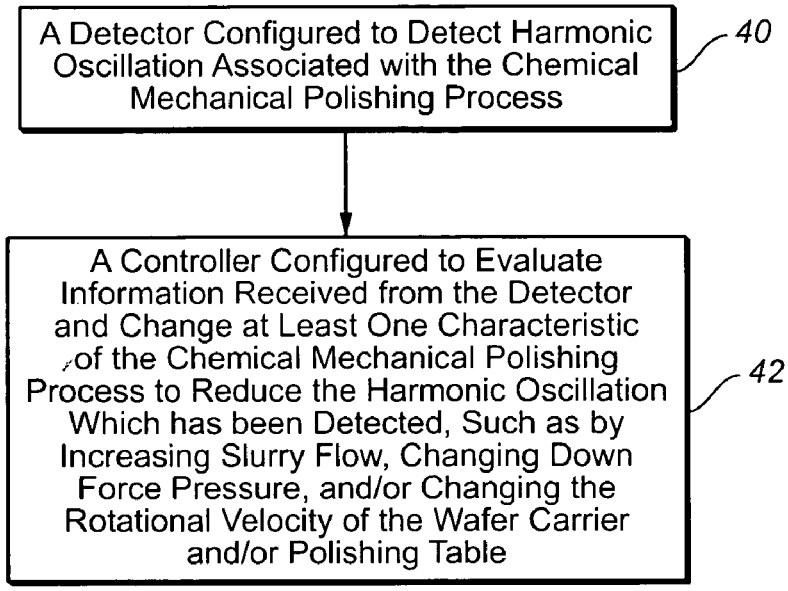

FIG. 5 illustrates a control system which can be used to practice the method illustrated in FIG. 3 and described hereinabove. The control system includes a detector (box 40 in FIG. 5) configured to detect harmonic oscillation associated with the chemical mechanical polishing process, and a reactor, such as a controller (box 42 in FIG. 5), preferably a Model Predictive Controller, configured to evaluate information received from the detector and change one or more characteristics of the chemical mechanical polishing process to reduce the harmonic oscillation which has been detected. Preferably, the detector is configured to sense frequency and either one or both of the detector and controller are configured to perform time analysis to determine whether harmonic oscillation is occurring. Preferably, the controller is configured to record changes as they are effected, and is configured to change characteristics of the chemical mechanical polishing process about a set point, and based on experiments which have been performed previously. Additionally, preferably, the detector and/or the controller is configured to determine a harmonic spectrum associated with scratches formed during the chemical mechanical polishing process.

Figure 6:
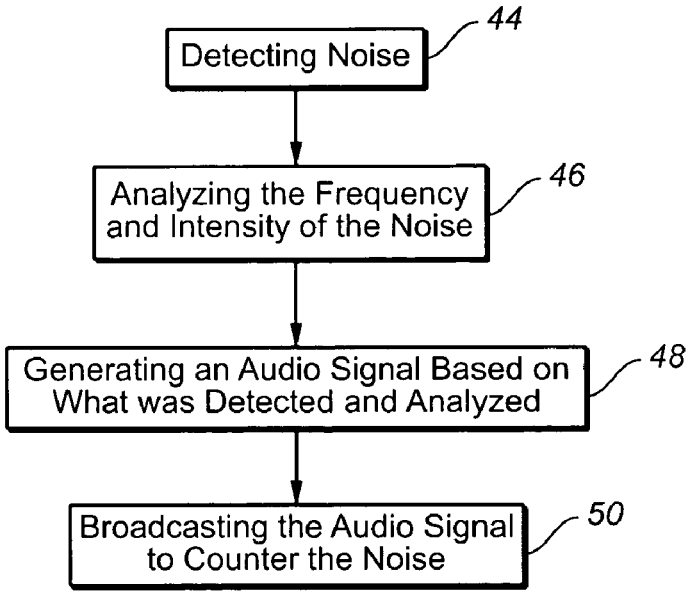

FIG. 6 illustrates a method which is directed at countering the noise which is associated with harmonic oscillation in a chemical mechanical polishing process. The method includes detecting noise (box 44 in FIG. 6), analyzing the frequency and intensity of the noise (box 46 in FIG. 6); generating an audio signal based on what was detected and analyzed (box 48 in FIG. 6); and broadcasting the audio signal (i.e., in the work environment) to counter the noise (box 50 in FIG. 6).

Figure 7:
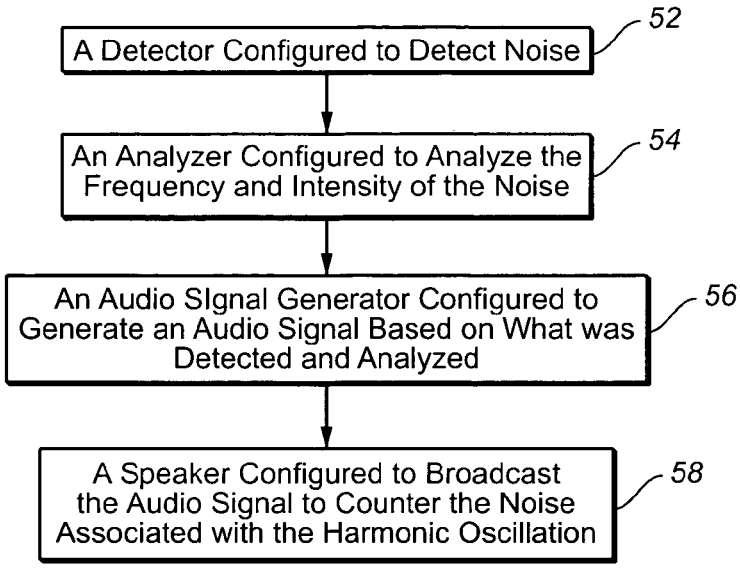

FIG. 7 illustrates a control system which can be used to practice the method illustrated in FIG. 6. The control system includes a detector (box 52 in FIG. 7) which is configured to detect noise, and a reactor which includes an analyzer (box 54 in FIG. 7), an audio signal generator (box 56 in FIG. 7), and at least one speaker (box 58 in FIG. 7). The analyzer is connected to the detector and is configured to analyze the frequency and intensity of the noise. The audio signal generator is configured to generate an audio signal based on what was detected and analyzed, and is configured to use the speaker to broadcast the audio signal to counter the noise associated with the harmonic oscillation.

Figure 8:
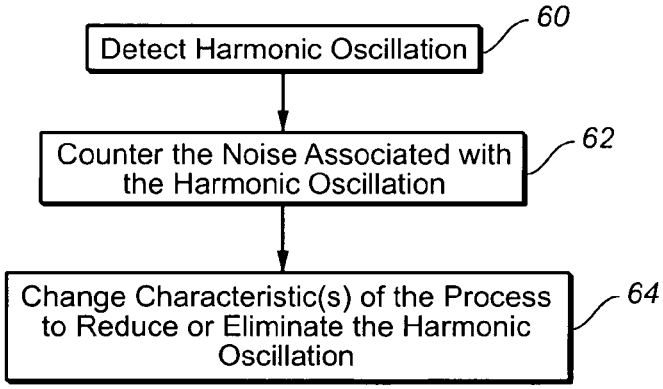

FIG. 8 illustrates a method wherein harmonic oscillation is detected (box 60 in FIG. 8) in a chemical mechanical polishing process, and the noise associated with the harmonic oscillation is countered (box 62 in FIG. 8) while the harmonic oscillation is either reduced or eliminated (box 64 in FIG. 8) by changing one or more characteristics of the process (such as by, for example, increasing slurry flow, changing the down force pressure can be changed, or changing the rotational velocity of the wafer carrier or polishing table).

Figure 9:
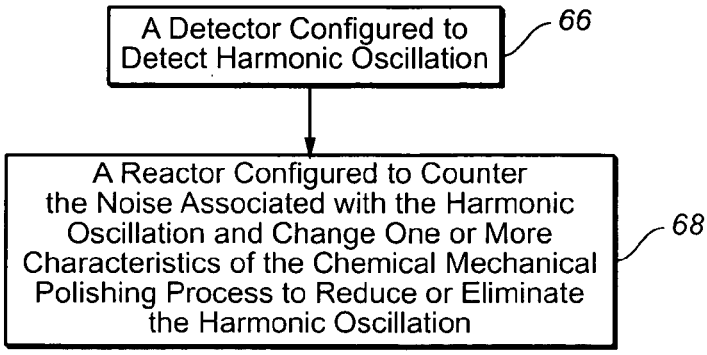

FIG. 9 illustrates a control system which can be used to practice the method shown in FIG. 8. The control system includes a detector (box 66 in FIG. 8) configured to detect harmonic oscillation, and a reactor (box 68 in FIG. 8) configured to counter the noise associated with the harmonic oscillation and change one or more characteristics of the chemical mechanical polishing process to reduce or eliminate the harmonic oscillation.

The methods and control systems described above detect harmonic oscillation in a chemical mechanical process and react by eliminating or reducing the harmonic oscillation and/or by countering the noise. By reducing or eliminating harmonic oscillation during a chemical mechanical polishing process, lower k dielectric films can be used. In other words, the chemical mechanical polishing process need no longer require that robust films be used, because the films need not have to withstand the effects of harmonic oscillations, which would otherwise be experienced. By countering the noise associated with harmonic oscillation, the work environment is improved.

Figure 10:
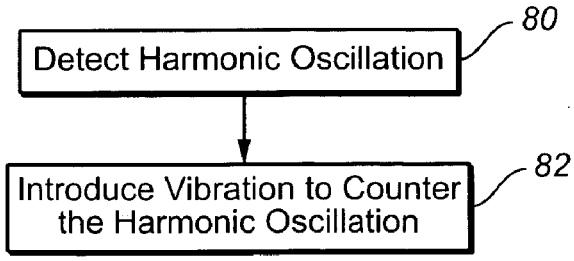
Figure 11:
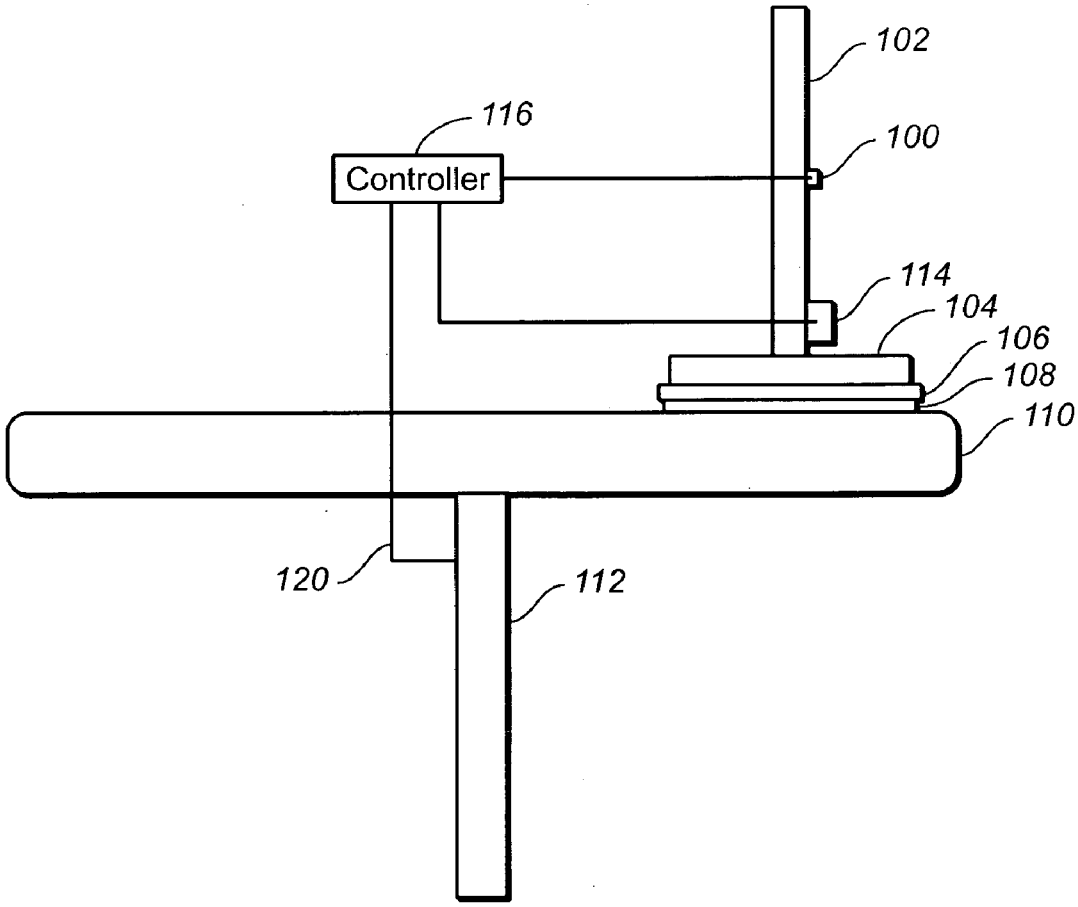

Alternatively, harmonic oscillation can be countered using a vibration signal. Specifically, FIG. 10 illustrates a method wherein harmonic oscillation is detected (box 80 in FIG. 10) in a chemical mechanical polishing process, and the platen is vibrated (box 82 in FIG. 10) to counter the oscillation. FIG. 11 illustrates a control system which can be used to practice this method. As shown, a vibration sensor 100 is positioned on a drive shaft 102 which drives the wafer polishing head 104. The polishing head 104 includes a carrier ring 106 which retains the wafer 108 against the polishing table 110 which is driven by a table drive shaft 112. A piezoelectric driver 114 is also provided on the polishing head drive shaft 102, and the sensor 100 and driver 114 are connected to a controller 116. When harmonic oscillation is sensed by the controller 116 (using the sensor 100), the controller 116 sends a vibration signal to the driver 114 to vibrate the platen and counter the harmonic oscillation. The sensor 100 and driver 114 need not be provided on the same item, one could be on the platen drive shaft and the other on the head drive shaft, for example. This is indicated by line 120 in FIG. 11.

While embodiments of the present invention are shown and described, it is envisioned that those skilled in the art may devise various modifications of the present invention without departing from the spirit and scope of the appended claims.

What is claimed is:

1. A method for improving a chemical mechanical polishing process, said method comprising: detecting harmonic oscillation; and countering the noise associated with the harmonic oscillation while the harmonic oscillation is either reduced or eliminated by changing one or more characteristics of the process.

2. A method of reacting to harmonic oscillation in a chemical mechanical polishing process, said method comprising: using a control system to detect either harmonic oscillation or noise associated therewith; and using the control system to react by at least one of: changing at least one characteristic of the chemical mechanical polishing process to reduce the harmonic oscillation, introducing vibration into the process to counter the harmonic oscillation, and generating an audio signal to counter the noise associated with the harmonic oscillation.

3. The method as recited in claim 2, further comprising sensing a frequency and performing time analysis to determine whether harmonic oscillation is occurring.

4. The method as recited in claim 2, further comprising using a detector to detect the harmonic oscillation and using a controller to evaluate information received from the detector, determine which characteristics are to be changed, and effect the change.

5. The method as recited in claim 2, said step of changing at least one characteristic of the chemical mechanical polishing process comprising at least one of increasing slurry flow, changing down force pressure, changing a rotational velocity of a wafer carrier, and changing rotational velocity of a polishing table.

6. The method as recited in claim 2, further comprising determining a harmonic spectrum associated with scratches formed during the chemical mechanical polishing process.

7. The method as recited in claim 2, further comprising recording changes as effected.

8. The method as recited in claim 2, further comprising recording changes as effected and changing characteristics of the chemical mechanical polishing process about a set point.

9. The method as recited in claim 2, further comprising performing experiments to determine how characteristics of the chemical mechanical polishing process should be changed to reduce harmonic oscillation.

10. The method as recited in claim 2, further comprising sensing a frequency and performing time analysis to determine whether harmonic oscillation is occurring, and using a controller to evaluate information received from the detector and determine which characteristics are to be changed.

11. The method as recited in claim 2, further comprising detecting noise, analyzing the frequency and intensity of the noise; generating an audio signal based on what was detected and analyzed; and broadcasting the audio signal to counter the noise.

12. The method as recited in claim 2, further comprising vibrating a platen to counter the harmonic oscillation.

13. A method of reducing harmonic oscillation in a chemical mechanical polishing process, said method comprising: performing experiments to determine how characteristics of the chemical mechanical polishing process should be changed to reduce harmonic oscillation; using a detector to detect harmonic oscillation associated with the chemical mechanical polishing process; using a controller to evaluate information received from the detector and determine which characteristics are to be changed; and using the controller to change at least one characteristic of the chemical mechanical polishing process to reduce the harmonic oscillation which has been detected.

14. A control system for reacting to harmonic oscillation in a chemical mechanical polishing process, said control system comprising a detector configured to detect either harmonic oscillation or noise associated therewith; and a reactor configured to receive information from the detector and react by at least one of: changing at least one characteristic of the chemical mechanical polishing process to reduce the harmonic oscillation, introducing vibration into the process to counter the harmonic oscillation, and generating an audio signal to counter the noise associated with the harmonic oscillation.

15. The control system as recited in claim 14, said reactor comprising a controller, said detector configured to sense frequency and at least of said detector and said controller configured to perform time analysis to determine whether harmonic oscillation is occurring.

16. The control system as recited in claim 14, said reactor comprising a controller, wherein said controller is configured to at least one of increase slurry flow, change down force pressure, change a rotational velocity of a wafer carrier, and change rotational velocity of a polishing table.

17. The control system as recited in claim 14, said reactor comprising a controller, at least one of said detector and said controller configured to determine a harmonic spectrum associated with scratches formed during the chemical mechanical polishing process.

18. The control system as recited in claim 14, said reactor comprising a controller, wherein said controller is configured to record changes as effected.

19. The control system as recited in claim 14, said reactor comprising a controller, wherein said controller is configured to record changes as effected and change characteristics of the chemical mechanical polishing process about a set point.

20. The control system as recited in claim 14, said reactor comprising a controller, wherein the controller is configured to change characteristics of the chemical mechanical polishing process based on experiments which have been performed.

21. The control system as recited in claim 14, said reactor comprising an analyzer connected to said detector, an audio signal generator connected to said analyzer, and a speaker connected to said audio signal generator, said detector configured to detect noise, said analyzer configured to analyze the frequency and intensity of the noise, said audio signal generator configured to generate an audio signal based on what was detected and analyzed, and said audio signal generator configured to use said speaker to broadcast the audio signal to counter the noise associated with the harmonic oscillation.

22. The control system as recited in claim 14, said reactor comprising a controller connected to a sensor and a driver, said controller configured to use the sensor to sense harmonic oscillation and use the driver to introduce vibration into the chemical mechanical polishing process to counter the harmonic oscillation.

* * * * *